US008613176B2

(12) United States Patent
Daas et al.

(10) Patent No.: US 8,613,176 B2
(45) Date of Patent: Dec. 24, 2013

(54) SUPPORT STRUCTURE SYSTEM

(75) Inventors: Kamal Daas, Bergschenhoek (NL); Doron Livnat, Rotterdam (NL)

(73) Assignees: Kamal Daas, Bergschenhoek (NL); Prodelta Investments b.v., Rotterdam (NL)

( * ) Notice: Subject to any disclaimer, the term of this patent is extended or adjusted under 35 U.S.C. 154(b) by 40 days.

(21) Appl. No.: 13/003,041

(22) PCT Filed: Jul. 10, 2009

(86) PCT No.: PCT/EP2009/005019

§ 371 (c)(1),
(2), (4) Date: May 2, 2011

(87) PCT Pub. No.: WO2010/003683

PCT Pub. Date: Jan. 14, 2010

(65) Prior Publication Data

US 2011/0258960 A1 Oct. 27, 2011

(30) Foreign Application Priority Data

Jul. 10, 2008 (DE) ..... 20 2008 009 284 U

(51) Int. Cl.
*E04H 12/18* (2006.01)

(52) U.S. Cl.
USPC ..... 52/645; 52/636; 52/652.1; 52/649.5

(58) Field of Classification Search
USPC ..... 52/632, 645, 652.1, 646, 636, 649.5, 52/109, 79.5, 713; 135/143, 144, 145
See application file for complete search history.

(56) References Cited

U.S. PATENT DOCUMENTS

| | | | | |
|---|---|---|---|---|
| 2,982,379 | A * | 5/1961 | Fisher | 52/111 |
| 3,011,586 | A * | 12/1961 | Harvey, Jr. | 182/115 |
| 3,593,481 | A | 7/1971 | Mikulin | |
| 4,604,844 | A | 8/1986 | Mikulas et al. | |
| 6,161,359 | A * | 12/2000 | Ono | 52/651.1 |
| 7,296,699 | B2 * | 11/2007 | Hung et al. | 211/189 |
| 2008/0302056 | A1 | 12/2008 | Daas et al. | |

FOREIGN PATENT DOCUMENTS

| | | | |
|---|---|---|---|
| JP | 05-092800 | A | 4/1993 |
| JP | 06-235263 | A | 8/1994 |
| JP | 11-241499 | A | 9/1999 |
| JP | 2008514526 | A | 5/2008 |

* cited by examiner

*Primary Examiner* — Chi Q Nguyen
(74) *Attorney, Agent, or Firm* — Dilworth & Barrese, LLP

(57) ABSTRACT

The present invention relates to a support structure system having a first support structure and having a second support structure, wherein the second support structure is at least partly received in the first support structure in at least one position of the support structure system; in that both support structures are able to be displaced or telescoped relative to one another; and in that the first and/or the second support structure is/are formed by a lattice support structure which can be inwardly folded and outwardly folded.

20 Claims, 7 Drawing Sheets

SUPPORT STRUCTURE SYSTEM

BACKGROUND OF THE INVENTION

The present invention relates to a support structure system having a first support structure and having a second support structure.

So-called lattice support structures are known from the prior art which have lattice bars connected to one another, with the lattice support structures having lattice bars converging in the longitudinal direction of the lattice support structure as well as lattice bars directly or indirectly connecting them. In this respect, the connection of the lattice bars among one another is released such that the spacing of the lattice bars extending in the longitudinal direction of the lattice support structures can be decreased and increased, whereby the lattice support structure can be folded inwardly, on the one hand, and folded outwardly, on the other hand.

Such lattice support structures which can be folded outwardly or inwardly on the one hand have the advantage of a high mechanical stability and on the other hand have the advantage that they can, for example, be folded inwardly for transport and storage purposes.

It is furthermore known from the prior art to position a plurality of such support structures adjacent one another in order, for example to achieve a particularly large height or length of such a support structure.

SUMMARY OF THE INVENTION

It is the underlying object of the invention to further develop a support structure system of the initially named kind in an advantageous manner.

This object is solved by a support structure system having the features herein. Provision is accordingly made for the second support structure system to be received in the first support structure at least partially in at least one position of the support structure system and for both support structures to be able to be displaced or telescoped relative to one another. One or both of these two support structures can be formed by a lattice support structure which can be folded inwardly or folded outwardly, that is, which is changeable in its dimension. The lattice support structure can have lattice bars which are connected to one another, with the lattice support structure having lattice bars extending in the longitudinal direction of the lattice support structure as well as lattice bars connecting them directly or indirectly, with the connecting lattice bars being connected to the lattice bars extending in the longitudinal direction such that the spacing of the lattice bars extending in the longitudinal direction of the lattice support structure being able to be decreased on the inward folding of the lattice support structure and being able to be increased on the outward folding of the lattice support structure.

A support structure system is thus provided comprising at least two support structures which are made displaceable relative to one another or which can be telescoped. The possibility is present in this manner of moving the inwardly disposed second support structure out of the outwardly disposed first support structure and then unfolding it for the purpose of setting up the support structure system into an operating state. This procedure is naturally not only restricted to two support structures. Support structure systems are also covered by the invention which include more than two such support structures. All of the support structures or at least some of the support structures or at least one of the support structures of the support structure system can thus be formed by the named lattice support structure, that is, it can be made variable in its dimensioning.

It is particularly advantageous for the second support structure to be formed by the lattice support structure, that is, to be inwardly foldable or outwardly foldable and to be connectable to the first support structure in the outwardly folded state. It is conceivable that the second support structure is formed by the lattice support structure and is not or is only partly received in the first support structure and is rather adjacent it in the longitudinal direction of the support structure in the outwardly folded state. It is thus conceivable to push the initially inwardly disposed second support structure fully or largely out of the outwardly disposed first support structure, then to unfold it and thereupon to connect it mechanically to the first support structure.

Provision can furthermore be made for the first support structure and the second support structure to be made identically or to have an at least comparable construction. In the state in which the second support structure is received at least partly in the first support structure, the first support structure is in a state which has a sufficiently large inner space for the reception of the second support structure. In this state, the first support structure can be fully or only partly outwardly folded. It is important that the first support structure is thus outwardly folded so much that a relative movement of both support structures relative to one another or a pushing out of the second support structure is possible.

Provision is made in a further embodiment of the invention for the second support structure to be formed by a lattice support structure which is dimensioned such that its lattice bars extending in the longitudinal direction are connectable to the first support structure in at least one position of the second support structure. It is thus conceivable preferably to connect the lattice bars extending in the longitudinal direction of the lattice support structures to one another after the outward telescoping. It is conceivable, for example, to connect the end regions of the lattice bars. This can be done e.g. by a bolt connection or the like.

Provision can be made in a further embodiment of the invention for both support structures to be formed by a lattice support structure and for both support structures to be dimensioned such that the lattice bars of both support structures extending in the longitudinal direction are flush with one another in at least one position of the support structures. Provision can be made in this case for the outer dimensions of the two support structures joined with one another to be identical or for the lattice bars extending in the longitudinal direction to be on one line so that a stable support structure system and a visually uniform overall impression results after the joining together of two lattice support structures.

Means are provided in a further embodiment of the invention by which the second support structure made as a lattice support structure is moved into its outwardly folded position when it has been telescoped out of the first support structure. It is conceivable that these means operate in an automated manner such that an outward folding of the second support structure takes place after the second support structure has been moved out of the first support structure.

The connecting lattice bars can be disposed in the outer surface or at the outer surfaces of the lattice support structure.

Provision is made in a further embodiment of the invention for the lattice bars extending in the longitudinal direction of the lattice support structure to form the outer edges of the lattice support structure. The lattice support structure can, for example be made rectangular or square in cross-section; however, the present invention is not restricted to this. Triangular or, for example, polygonal cross-sections can also be considered.

The lattice support structure can have a structure repeating in the longitudinal direction comprising lattice bars extending in the longitudinal direction or connecting lattice rods.

Provision is made in a further embodiment of the invention for at least some of the connecting lattice bars to be formed by connection struts which extend in the outwardly folded state of the lattice support structure perpendicular to the longitudinal direction of the lattice support structure from one to another of the lattice bars extending in the longitudinal direction of the lattice support structure.

Provision can be made in this respect for the connection struts to have at least one joint by means of which they can be adjusted between an inwardly folded state and an outwardly folded state.

Provision is made in a further embodiment of the invention for connection struts spaced apart in the longitudinal direction to be connected to one another.

Provision can finally be made for locking means to be arranged by means of which the connecting lattice bars or also the lattice bars extending in the longitudinal direction to be fixable in at least one position. It can thereby be achieved that the lattice support structure is secured against an unintended inward folding in the outwardly folded state.

Provision can finally be made for means to be provided which act on at least two of the connecting lattice bars and/or of the lattice bars extending in the longitudinal direction such that the spacing of the respective lattice bars with respect to one another can be increased or decreased, whereby the lattice support structure folds inwardly or folds outwardly. These means can, for example, be driven by a motor pneumatically or hydraulically or by the like.

Provision is made in a further embodiment of the invention for at least one further support structure to be received in the second support structure in at least one position of the support structure system and for the second support structure and the further support structure to be displaceable with respect to one another or to be able to be telescoped. The present invention is thus not restricted to the support structure system comprising two support structures. Provision can rather be made for any desired number of support structures to be joined to one another or to be received within one another in a telescopic manner.

The invention furthermore relates to a lattice support structure with structures which can be spread apart, in particular wherein the lattice support structure has pivotably arranged lattice bars, wherein the pivotable connection is made such that one of the parts pivotably connected to one another has a projection; and in that the other one of the pivotably connected parts has a groove which is bounded on three sides by walls and in which the projection of the other part is pivotably received. The base of the groove thus serves as a boundary so that a pivoting of the lattice bar is only possible for so far until the one of the named parts lies on the groove base. In this position, the lattice bar is thus blocked or a further pivoting is not possible. Such a pivotable connection can be provided where two segments of a lattice bar are pivotably connected to one another and/or where a lattice bar is pivotally connected to another part of the lattice support structure.

The lattice bar can have the projection at its one end region and the named groove at its other end region. It is possible in this manner to connect a plurality of lattice bars to one another or to provide lattice bars of different length. It is also generally conceivable to make both ends of the lattice bar with grooves or with the named projections.

It is particularly advantageous for a braking device or a fixing device to be provided which fixes the lattice bars in a specific pivot position. It can, for example, be a drum brake, a disk brake or a shoe brake. The brake can e.g. be actuated hydraulically or mechanically. The brake can have brake shoes which have two projections, said brake simultaneously coming into contact with the respective adjacent part, for example with the named projection, and thus developing an ideal braking effect, on actuation of the brake.

BRIEF DESCRIPTION OF THE DRAWINGS

Further details and advantages of the invention will be explained in more detail with reference to an embodiment shown in the drawing. There are shown.

DESCRIPTION OF THE PREFERRED EMBODIMENTS

Figure 1:
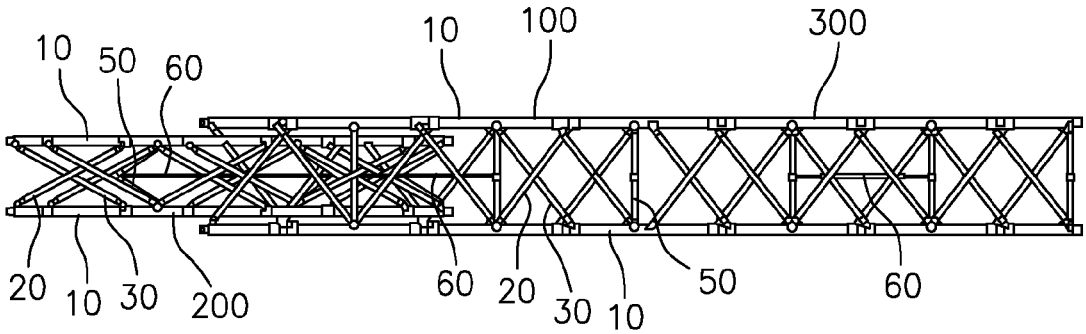
FIG. 1: a schematic representation of the support structure system with a first support structure and a second support structure.

FIG. 1 shows the support structure system in accordance with the present invention in a schematic side representation. In the embodiment shown here it comprises a first support structure 100 and a second support structure 200 received therein. As can further be seen from FIG. 1, a further support structure 300 is already connected to the first support structure 100.

Each of the lattice support structures 100, 200, 300 comprises lattice bars 10 extending in the longitudinal direction of the lattice support structure and lattice bars 20, 30, 50 connecting them. In this respect, the lattice bars 20, 30 are each pivotably connected to one of the lattice bars 10 extending in the longitudinal direction and are displaceably connected to an adjacent lattice bar 10 by means of a sliding sleeve 20', 30'.

The connecting lattice bars 50 are made as connection struts which extend perpendicular to the lattice bars 10 extending in the longitudinal direction in the outwardly folded state, as can be seen from FIG. 1. The connection struts 50 are provided with a joint by means of which they can be pivoted inwardly.

As can further be seen from FIG. 1, a respective two of the connection struts 50 are connected to one another by a rod 60. This rod 60 on the one hand secures the spacing of the connection struts 50 with respect to one another in the outwardly folded state of the lattice support structure and in this manner prevents an unintended inward folding of the lattice support structure.

The rods 60 can furthermore serve to fold the lattice support structure outwardly in that the spacing of the two end points of the rod 60 is increased or is decreased for the purpose of the inward folding. The drive of this rod can take place by a motor, pneumatically or also hydraulically, etc.

The support structures 100, 200, 300 are made identical. In the state shown in FIG. 1, the second support structure 200 is in a partly inwardly folded state such that it fits into the inner space of the outwardly folded first support structure 100 and is then received therein in a displaceable or telescopic manner.

Figure 2:
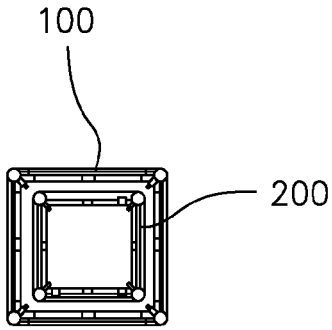
FIG. 2: a cross-sectional view of the support structure system in accordance with FIG. 1.

FIG. 2 shows the state in which the second support structure 200 is received in the inner space of the first support structure 100 in a cross-sectional representation.

Figure 3:
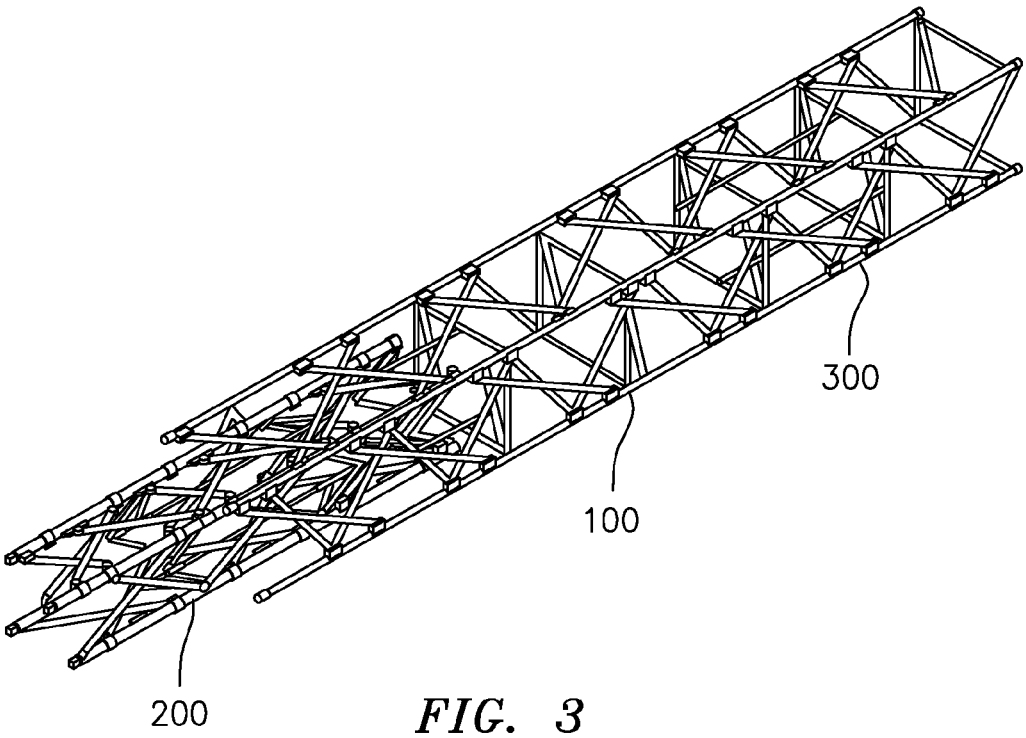
FIG. 3: a perspective view of the support structure system in accordance with FIG. 1.

FIG. 3 shows the arrangement in a perspective representation.

Figure 4:
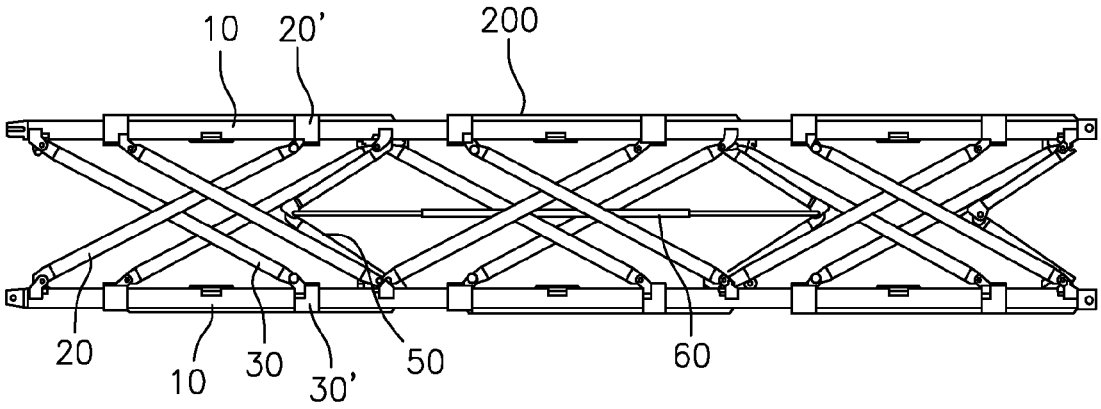
FIG. 4: a schematic representation of the second support structure.

The second support structure 200 is shown in a schematic view in FIG. 4. As can be seen from FIG. 4, this second support structure 200, as also the first support structure 100, comprises lattice bars 10 extending in the longitudinal direction as well as connecting lattice bars 20, 30, 50. In this connection, the connecting lattice bars 20, 30 are pivotably arranged at one of the lattice bars 10 extending in the longitudinal direction and are arranged displaceably by a sliding sleeve 20', 30' at the other lattice bar 10 extending in the longitudinal direction.

The connection struts 50 are arranged pivotably at two lattice bars 10 extending adjacently in the longitudinal direction and are connected to one another by a joint arranged approximately centrally. The rod 60 engages at this central region and can be telescoped in and out, whereby a folding outward or folding inward of the support structure can occur.

Figure 5:
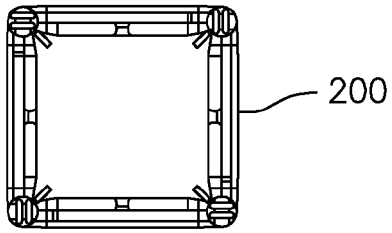
FIG. 5 a cross-sectional representation of the second support structure in accordance with FIG. 4.
Figure 6:
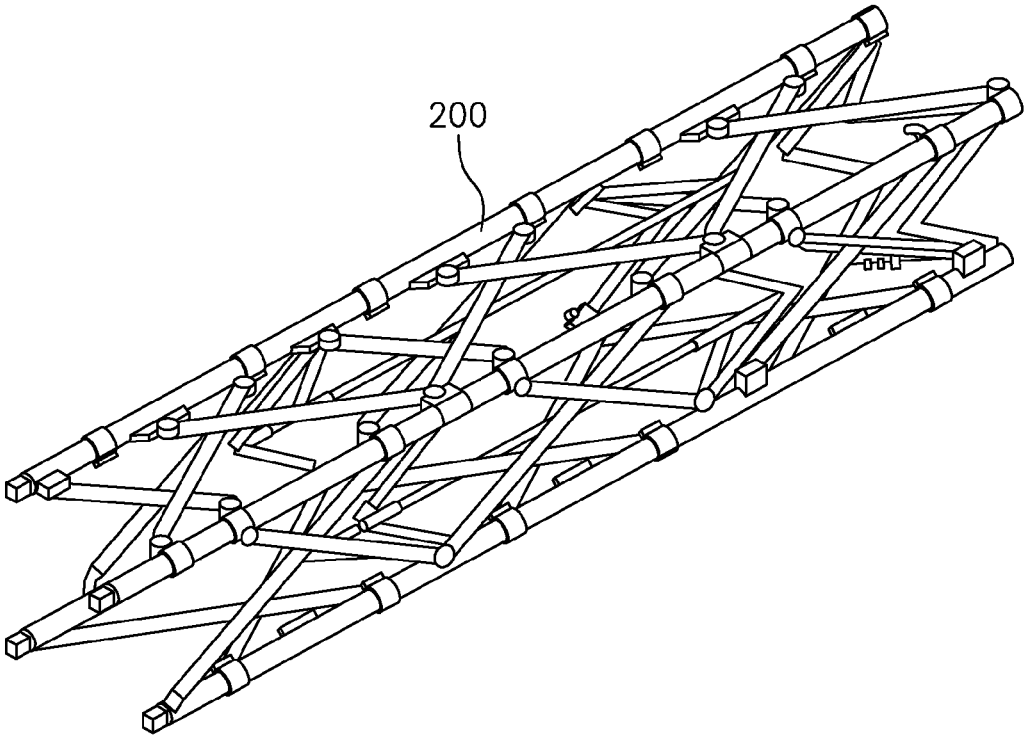
FIG. 6: a perspective representation of the support structure in accordance with FIG. 4.

FIG. 5 shows the second support structure in accordance with FIG. 4 in a cross-sectional representation and FIG. 6 in a perspective view.

Figure 7:
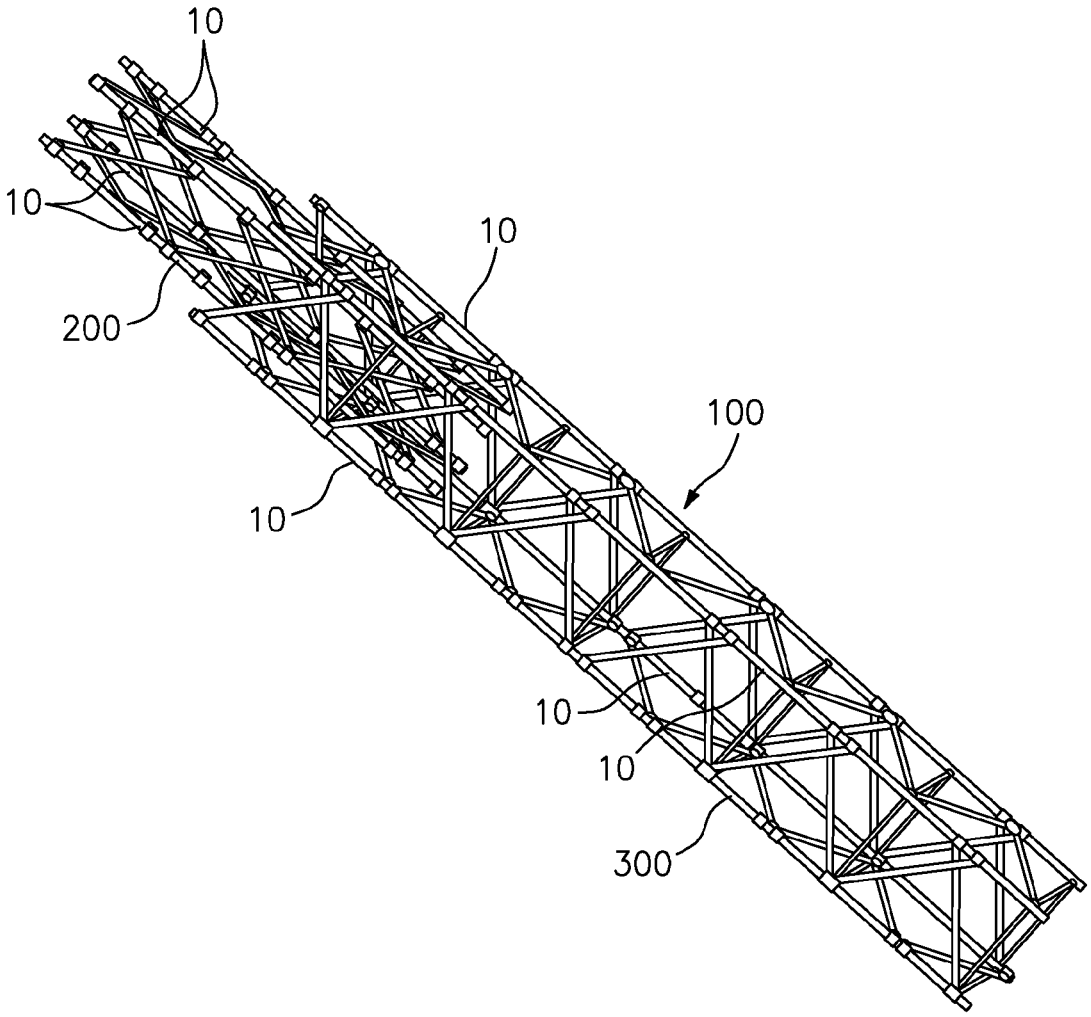
FIG. 7: a further perspective representation of the support structure system in accordance with FIG. 1.

A further perspective representation of the arrangement in accordance with FIG. 1 results from FIG. 7. FIG. 7 shows the state in which the second support structure 200 is still partly received in the inner space of the first support 100. After the full pushing out of the second support structure 200, it is folded outwardly and then adopts the dimensions of the first support structure 100. This has the result that the lattice bars 10 of the first support structure extending in the longitudinal direction can be connected to the lattice bars 100 of the second support structure 200 extending in the longitudinal direction. It is conceivable to connect the two support structures 100, 200 by a secured bolt connection, etc., for example.

In the embodiment shown in FIG. 7, the third support structure 300 shown at the bottom is in this way already connected to the first support structure 100. The second support structure 200 is still in the partly inwardly folded position and is outwardly folded after it has left the inner space of the first support structure 100. This outward folding can take place in an automated manner as soon as it is recognized that the second support structure 200 has left the inner space of the first support structure.

FIG. 8 shows further representations of the support structure system in accordance with the invention.

Figure 8A:
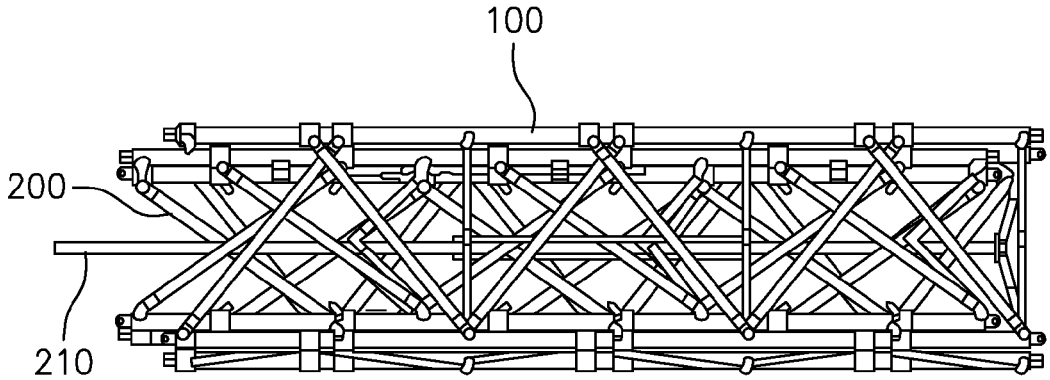
FIGS. 8*a-f*: different representations of the support structure system in accordance with the present invention, with FIGS. 8*a* and 8*b* respectively showing side and perspective views of one representation, FIGS. 8*c* and 8*d* respectively showing elevational and end views of another representation, and FIGS. 8*e* and 8*f* showing perspective views of a further representation.
Figure 8B:
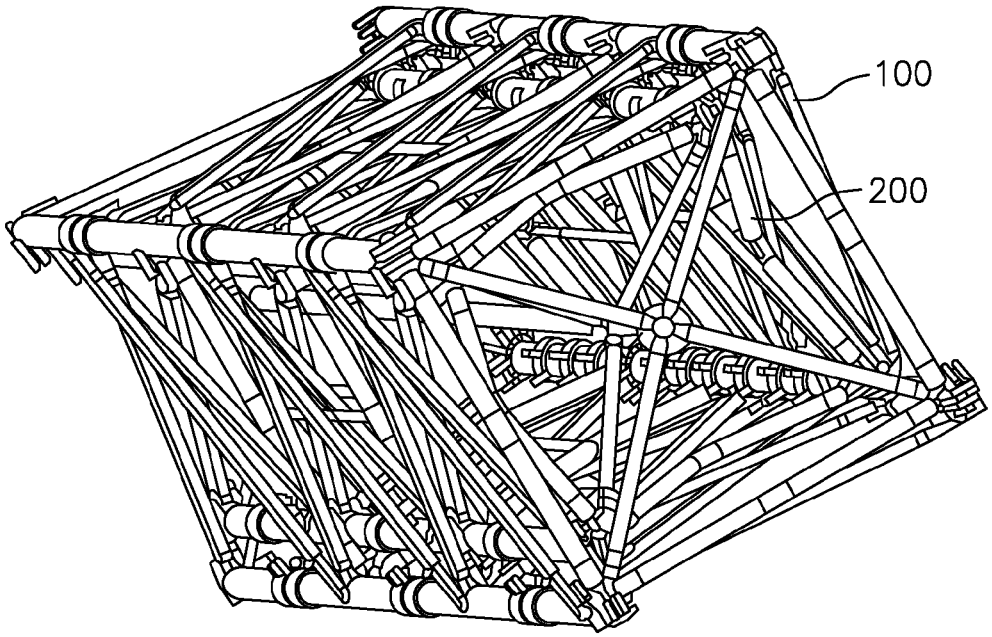
Figure 8C:
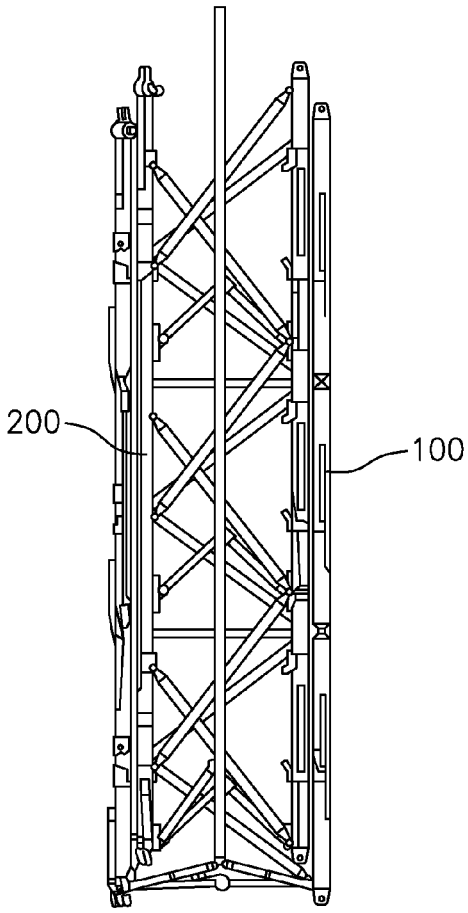
Figure 8D:
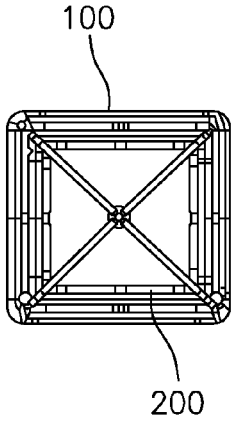

In this respect, FIG. 8*a* shows, in a side view, two support structures 100, 200 which are received or telescoped into one another and FIG. 8*b* shows this arrangement in a perspective view. FIG. 8*c* likewise shows two support structures 100, 200 which are received in one another and FIG. 8*d* shows a cross-sectional representation through the arrangement in accordance with FIG. 8*c*. A linkage 210 can be seen from FIG. 8*a* which engages at the lattice bars 10 extending in the longitudinal direction and which serves the folding outwardly or inwardly of the first support structure 100 and/or of the second support structure 200.

Figure 8E:
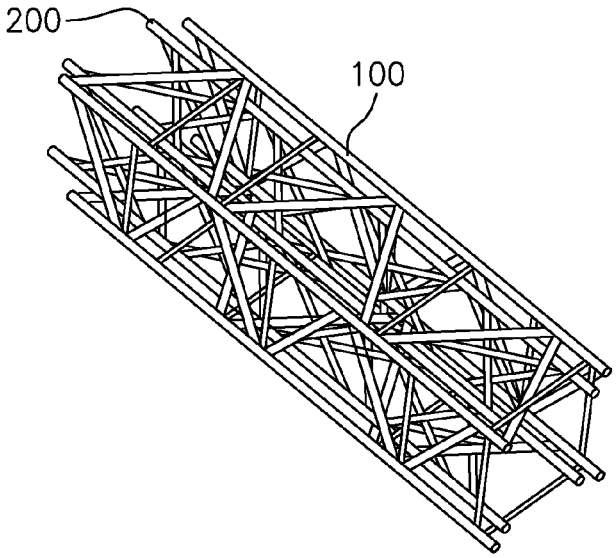
Figure 8F:
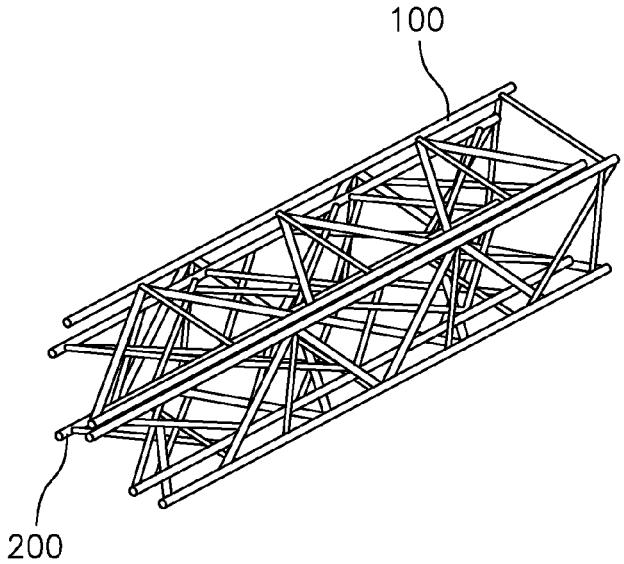

FIGS. 8*e* and 8*f* finally show, in a perspective view, embodiments of the support structure system in accordance with the present invention with a second support structure 200 which is received in a first support structure 100.

The support structure system in accordance with the present invention can be used for any desired applications, for example as a support, a carrying structure, a component of a crane, etc.

The invention claimed is:

1. A support structure system having a first support structure (100) and a second support structure (200), wherein both support structures (100, 200) are able to be displaced or telescoped relative to one another;

at least one of the first (100) and the second support structures (200) is formed by a lattice support structure which can be inwardly folded and outwardly folded; and the second support structure (200) is at least partly received in an inner space of the first support structure (100) in at least one position of the support structure system; wherein the second support structure (200) is formed by the lattice support structure and can be connected in the outwardly folded state to the first support structure (100).

2. A support structure system in accordance with claim 1, wherein the lattice support structure has lattice bars (10, 20, 30, 50) connected to one another, with the lattice support structure having lattice bars (10) extending in the longitudinal direction of the lattice support structure and lattice bars (20, 30, 50) connecting the lattice bars (10) extending in the longitudinal direction directly or indirectly, with the connecting lattice bars (20, 30, 50) being connected to the lattice bars (10) extending in the longitudinal direction such that the spacing of the lattice bars (10) extending in the longitudinal direction of the lattice support structure being able to be reduced on the inward folding of the lattice support structure and being able to be increased on the outward folding of the lattice support structure.

3. A support structure system in accordance with claim 2, wherein at least some of the connecting lattice bars (20, 30, 50) are formed by connection struts (50) which extend in the outwardly folded state of the lattice support structure perpendicular to the longitudinal direction of the lattice support structure from one to another of the lattice bars (10) extending in the longitudinal direction of the lattice support structure.

4. A support structure system in accordance with claim 3, wherein the connection struts (50) have at least one joint by which they can be adjusted between an inwardly folded and an outwardly folded state.

5. A support structure system in accordance with claim 3, wherein connection struts (50) spaced apart in the longitudinal direction of the lattice support structure are connected to one another.

6. A support structure system in accordance with claim 1, wherein the second support structure (200) is formed by the lattice support structure and, in the outwardly folded state, is not received or is only partly received in the first support structure (100) and rather adjoins in the longitudinal direction of the support structure system.

7. A support structure system in accordance with claim 1, wherein the first support structure (100) and the second support structure (200) are made identical.

8. A support structure system in accordance with claim 1, wherein the second support structure (200) is formed by a lattice support structure which is dimensioned such that its lattice rods (10) extending in the longitudinal direction can be connected to the first support structure (100) in at least one position of the second support structure (200).

9. A support structure system in accordance with claim 1, wherein both support structures (100, 200) are formed by a lattice support structure; and both support structures (100, 200) are dimensioned such that the lattice bars (10) of both support structures (100, 200) extending in the longitudinal direction can be connected to one another in at least one position of the support structures (100, 200).

10. A support structure system in accordance with claim 1, wherein both support structures (100, 200) are formed by a lattice support structure; and both support structures (100, 200) are dimensioned such that the lattice bars (10) of both support structures (100, 200) extending in the longitudinal direction are flush with one another in at least one position of the support structures (100, 200).

11. A support structure system in accordance with claim 1, wherein means are provided by which the second support structure (200) made as a lattice support structure is moved into its outwardly folded position when it has been telescoped out of the first support structure (100).

12. A support structure system in accordance with claim 1, wherein the connecting lattice bars (20, 30, 50) are disposed in the outer surface or the outer surfaces of the lattice support structure.

13. A support structure system in accordance with claim 1, wherein the lattice bars (10) extending in the longitudinal direction of the lattice support structure form the outer edges of the lattice support structure.

14. A support structure system in accordance with claim 1, wherein the lattice support structure has a structure repeating in the longitudinal direction of lattice bars (10) extending in the longitudinal direction as well as connecting lattice bars (20, 30, 50).

15. A support structure system in accordance with claim 1, wherein locking means are provided by which the connecting lattice rods (20, 30, 50) can be fixed in at least one position.

16. A support structure system in accordance with claim 1, wherein means are provided which act on at least two of the connecting lattice bars (20, 30, 50) or of the lattice bars (10) extending in the longitudinal direction such that the spacing of the lattice bars (10, 20, 30, 50) can be increased or decreased relative to one another, whereby the lattice support structure folds outwardly or folds inwardly.

17. A support structure system in accordance with claim 1, wherein at least one further support structure is received in the second support structure (200) in at least one position of the support structure system;

and the second support structure (200) and the further support structure can be displaced or telescoped relative to one another.

18. A lattice support structure with structures which can be spread apart, in particular a lattice support structure of one or more support structures of a support structure system in accordance with claim 1, wherein the lattice support structure has pivotably arranged lattice bars, a pivotable connection for the respective pivotally-arranged lattice bar is made such that a first one of parts pivotably connected to one another has a projection; and a second one of the pivotably connected parts has a groove which is bounded on three sides by walls and in which the projection of the first part is pivotably received.

19. A lattice support structure in accordance with claim 18, wherein the lattice bars have the projection at one end region and the groove at an opposite end; or the lattice bars have grooves or projections at both end regions.

20. A support structure system in accordance with claim 1, wherein the second support structure (200) is formed by a lattice support structure which can be inwardly folded and outwardly folded into or out of the first support structure (100).

* * * * *